US010239222B2

(12) United States Patent
Schomber, Jr. et al.

(10) Patent No.: US 10,239,222 B2
(45) Date of Patent: Mar. 26, 2019

(54) INSERT AND PIN FOR PIN EJECTOR SYSTEM FOR A ROTARY CUTTING DIE ARRANGEMENT AND ASSOCIATED METHODS

(71) Applicant: Roto-Die Company, Inc., St. Louis, MO (US)

(72) Inventors: Charles E. Schomber, Jr., Catawissa, MO (US); Jeffery Miles Burris, House Springs, MO (US)

(73) Assignee: ROTO-DIE COMPANY, INC., St. Louis, MO (US)

( * ) Notice: Subject to any disclaimer, the term of this patent is extended or adjusted under 35 U.S.C. 154(b) by 368 days.

(21) Appl. No.: 15/209,893

(22) Filed: Jul. 14, 2016

(65) Prior Publication Data

US 2018/0015628 A1 Jan. 18, 2018

(51) Int. Cl.

| | |
|---|---|
| ***B26D 7/18*** | (2006.01) |
| ***B26D 1/16*** | (2006.01) |
| ***B26D 1/62*** | (2006.01) |
| ***B26F 1/38*** | (2006.01) |

(52) U.S. Cl.
CPC ..... *B26D 7/1818* (2013.01); *B26D 1/626* (2013.01); *B26F 1/384* (2013.01)

(58) Field of Classification Search
CPC ..... B26D 7/1818; B26D 1/626; B26D 2007/1872; B26D 7/1836; Y10T 83/2133; Y10T 83/4836; Y10T 83/219; Y10T 225/336; Y10T 225/329; Y10T 83/7851; Y10T 83/2109; Y10T 83/2105; Y10T 83/2107; Y10T 83/2122; Y10T 83/2124; B26F 1/384
USPC ..... 83/123, 154, 128, 345, 107, 151, 103, 83/117; 493/373, 342, 82, 83, 472, 371, 493/471
See application file for complete search history.

(56) References Cited

U.S. PATENT DOCUMENTS

| | | | | |
|---|---|---|---|---|
| 2,374,194 A * | 4/1945 | Grupe | B41F 13/18 | 100/155 R |
| 2,633,684 A * | 4/1953 | Rohdin | B65B 9/02 | 34/242 |
| 3,698,271 A * | 10/1972 | Kesten | B26D 7/1863 | 83/99 |
| 4,499,802 A | 2/1985 | Simpson | | |
| 5,138,923 A | 8/1992 | Kent et al. | | |
| 5,300,009 A * | 4/1994 | Bittenbender | B26D 7/1836 | 225/97 |

(Continued)

*Primary Examiner* — Ghassem Alie
(74) *Attorney, Agent, or Firm* — Thompson Coburn LLP

(57) ABSTRACT

An insert assembly is received in a recess on the outer surface of a rotary cutting cylinder. The insert has a hole for a slug ejector pin which is slidingly engagable with the insert. The hole is arranged on the insert to communicate with a through hole in the recess that extends into the interior of the cylinder. When the slug ejector pin is inserted in the pin hole, the pin proximal end is received in the recess hole adjacent to the compressible core and the pin distal end projects from an outer surface of the insert. When the pin is assembled with the insert and the insert is assembled with the cylinder, the pin proximal end operatively engages the compressible core when the pin retracts into the pin hole of the insert and the pin proximal end operatively engages the insert when the pin projects from the pin hole.

15 Claims, 5 Drawing Sheets

(56) References Cited

U.S. PATENT DOCUMENTS

| | | | | |
|---|---|---|---|---|
| 5,365,815 | A * | 11/1994 | Pfaff, Jr. ..... | B26D 7/1818 83/128 |
| 5,701,789 | A | 12/1997 | Okonski | |
| 6,644,153 | B1 | 11/2003 | Gordon | |
| 6,679,147 | B1 | 1/2004 | Chaulklin | |
| 6,966,245 | B1 | 11/2005 | Simpson | |
| 7,111,534 | B1 | 9/2006 | Simpson | |
| 2003/0089205 | A1 | 5/2003 | Pfaff | |
| 2004/0089129 | A1 | 5/2004 | Toth | |
| 2004/0110620 | A1 | 6/2004 | Georgiades | |
| 2007/0283795 | A1 | 12/2007 | Greenleaf | |
| 2010/0037741 | A1 | 2/2010 | Luquette | |
| 2011/0203435 | A1 | 8/2011 | Smithwick | |
| 2011/0265620 | A1 | 11/2011 | Kicinski et al. | |
| 2012/0055301 | A1 | 3/2012 | Compagnone et al. | |
| 2012/0285306 | A1 | 11/2012 | Weibelt | |
| 2013/0228056 | A1 | 9/2013 | Beguin | |
| 2014/0041493 | A1 | 2/2014 | Dulaney | |

* cited by examiner

INSERT AND PIN FOR PIN EJECTOR SYSTEM FOR A ROTARY CUTTING DIE ARRANGEMENT AND ASSOCIATED METHODS

BACKGROUND AND SUMMARY

The disclosure relates to a pin eject system in a rotary cutting die arrangement comprising a rotary die cutting cylinder and an anvil roll with a media passing therebetween. The rotary cutting die arrangement is used in the converting industry to cut parts from a media passing between the two cylinders. The pin eject system facilitates the separation of the cut part from the media.

In one aspect, the disclosure relates to a rotary die cutting cylinder of the rotary die cutting arrangement with an insert removably attached to the outer surface of the rotary die cutting cylinder. The insert receives a pin to provide the pin ejection feature. The insert may be received in a recess formed on the outer surface of the rotary die cutting cylinder and held in position with a mechanical fastener with the pin projecting from the surface of the insert. The insert may also have a die cavity and the ejector pin may project through a hole in the die cavity of the insert. The pin is located within the insert and is biased outward from the outer surface of the rotary die cutting cylinder by a compressible, springing core disposed in the bore of the rotary cutting cylinder. During cutting, the media is compressed, for instance, in a die cavity formed on the face of the insert, and the anvil roll, and cut. The portion of the media in the cavity pushes against the ejector pin and the pin retracts through its hole in the insert against the compressible core. As the insert and die cavity rotate away from the anvil roll, the pin moves outward by the biasing force of the compressible core and ejects the part (or die cut slug) from the cavity. The pin eject system prevents the build-up of small die cut slugs in die cavities of the die.

In another aspect, the disclosure relates to an anvil roll of the rotary die cutting arrangement with an insert and a pin ejection feature that cooperates with a die cavity of a rotary cutting cylinder to maintain the cut media within the die cavity or to separate the media from the cut media within the die cavity. The insert may be received in a recess formed on the outer surface of the anvil roll and held in position with a mechanical fastener with the pin projecting from the surface of the insert. In one example, when the anvil rotates, the insert and pin eject feature of the anvil roll comes into register with die cavity of the rotary cutting cylinder. The pin housed in the insert projects into a cutting die area of the cutting cylinder and is biased outward by a compressible, springing core disposed in the bore of the anvil roll. The ejector pin projects through its hole in the insert in the anvil roll outer surface and comes into register with the die cavity at selected points during cutting. As the media is compressed in the cavity between the rotary cutting cylinder and the anvil roll, and cut, the pins push the material into the die cavity. As another example, inserts with the pins may be provided on other areas of the anvil roll. The pins may project outward from the anvil roll in areas outside of the die cavity during cutting. As the media is compressed in the cavity between the rotary cutting cylinder and the anvil roll, and cut, the pins push the material outside of the die cavity away from the material within the die cavity, thereby facilitating the removal of the die cut portion from the remaining portion of the media outside of the cavity.

More in particular, the disclosure is directed to the insert assembly comprising the insert and pin which facilitates the set-up of a cylinder, and changeover from job to job. The insert assembly, which is removably attachable at the outer surface of the rotatory die cutting cylinder, eliminates the need to install pins through the bore of the cylinder and reduces set-up of the cylinder and increases operational flexibility.

DETAILED DESCRIPTION

Figure 1:
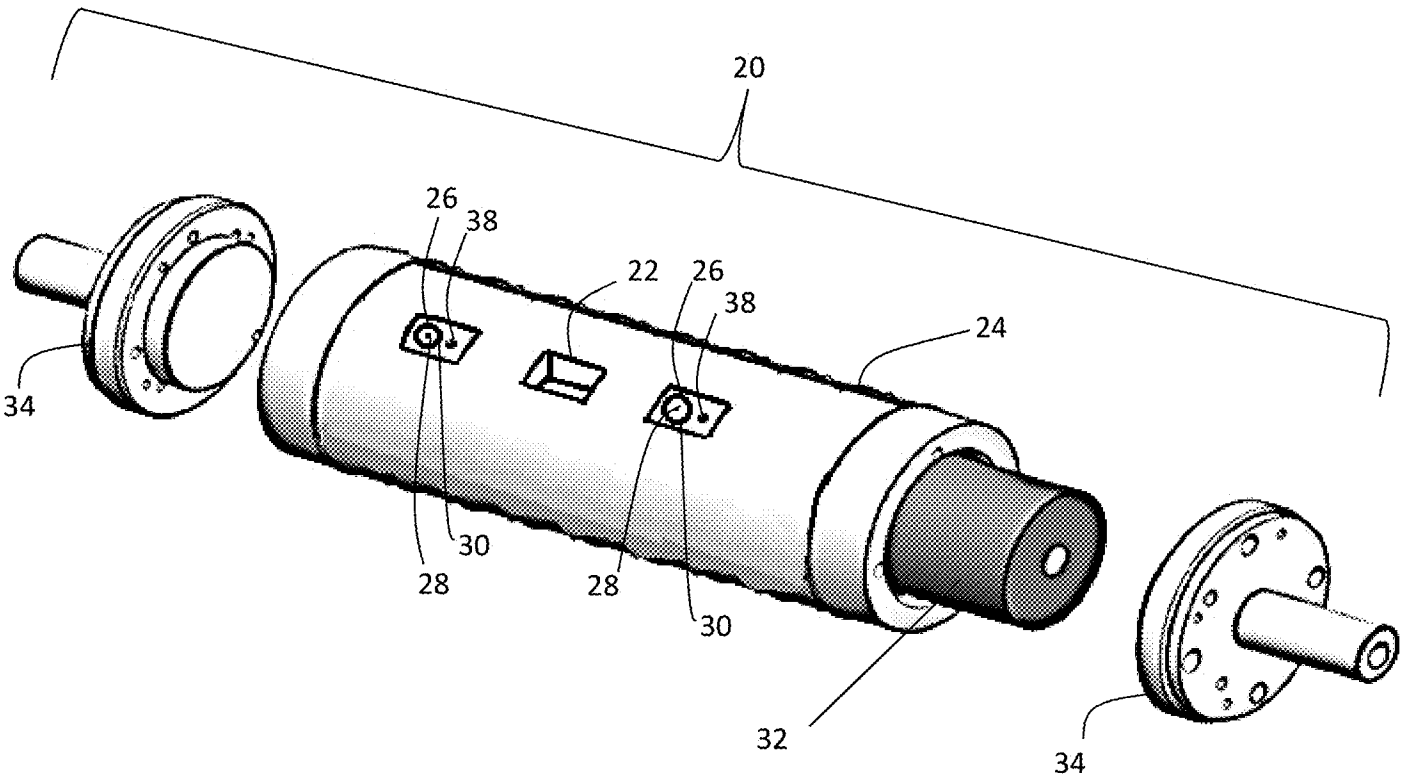
FIG. 1 is an exploded view of a rotary die cutting cylinder showing a compressible core, axial opposite journal bearers, and recesses on an outer diameter surface of the cutting cylinder for receiving one or more insert assemblies which define a plurality of die cavities with ejector pins in the die cavities.
Figure 2:
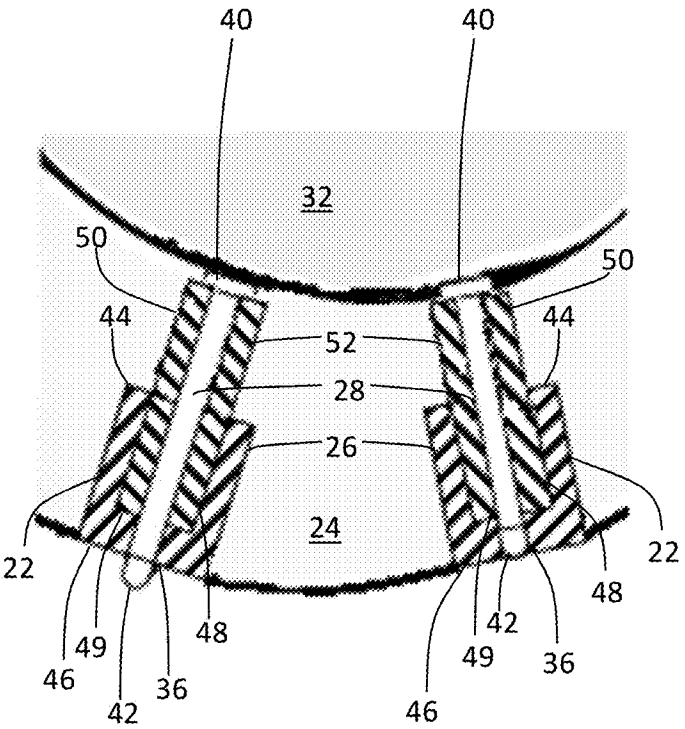
FIG. 2 is a partial cross-sectional view of one ejector pin engaging an insert assembly and another ejector pin pushing against the compressible core.
Figure 3:
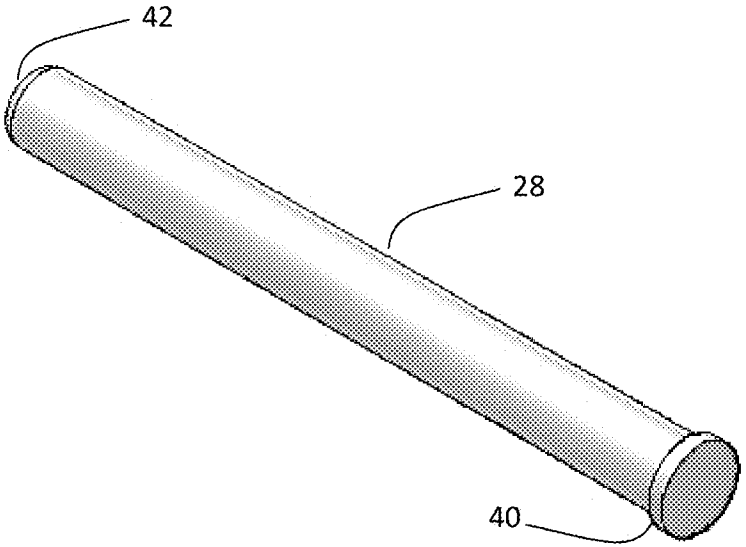
FIG. 3 is a perspective view of an ejector pin.
Figure 4:
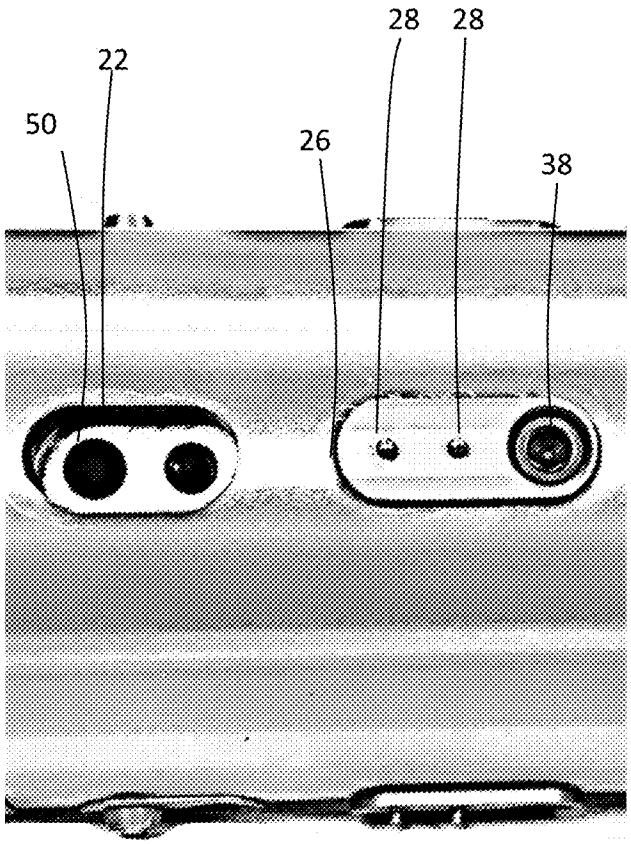
FIG. 4 is a side view of an exemplary rotary die cutting cylinder showing one insert without a die cutting cavity received in a recess of the outer face of the rotary cutting die cylinder and additional detail of an empty recess.
Figure 5:
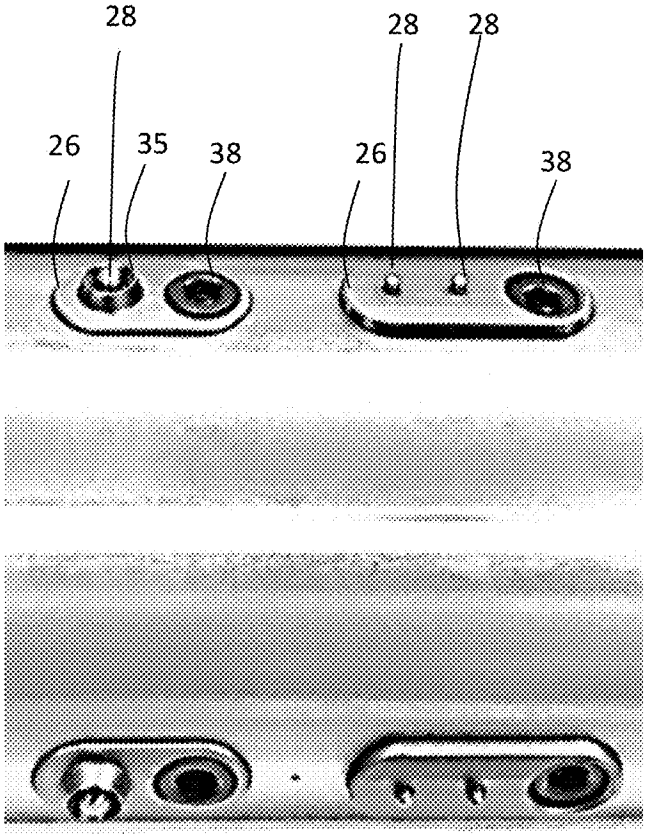
FIG. 5 is another side view of the rotary die cutting cylinder of FIG. 4 rotating about a center axis of the cylinder showing one insert with a die cutting cavity and another insert without a die cutting cavity.
Figure 6:
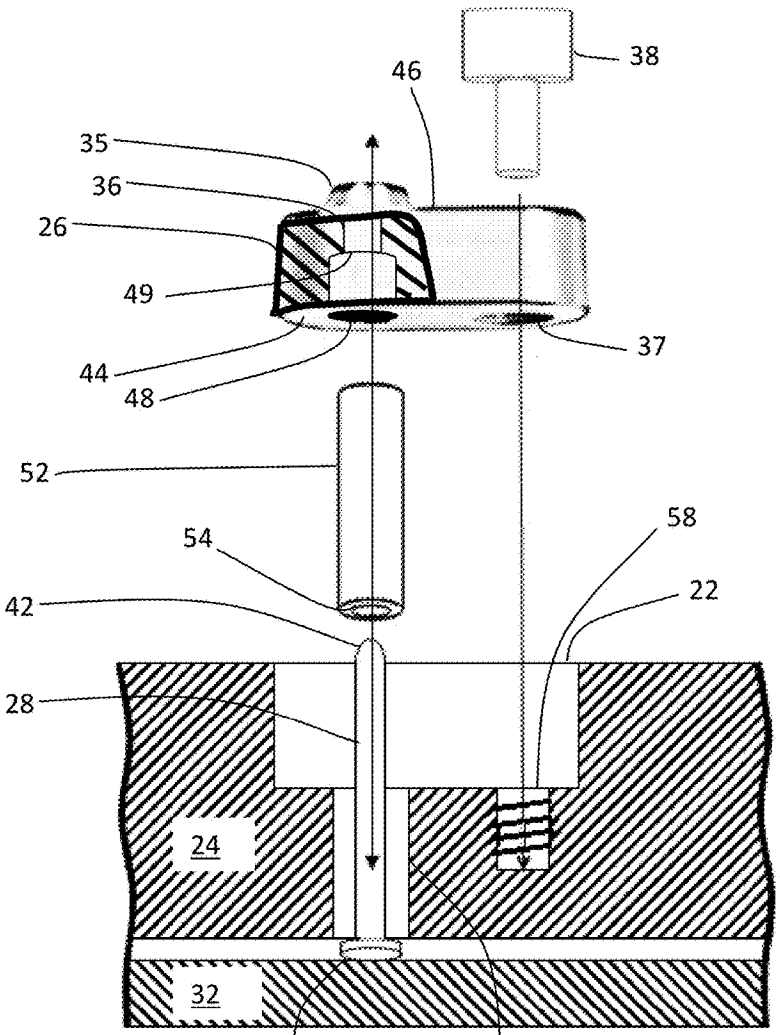
FIG. 6 is an exploded cross-sectional view of an exemplary insert assembly showing an insert with a die cavity, a bushing and a pin.
Figure 7:
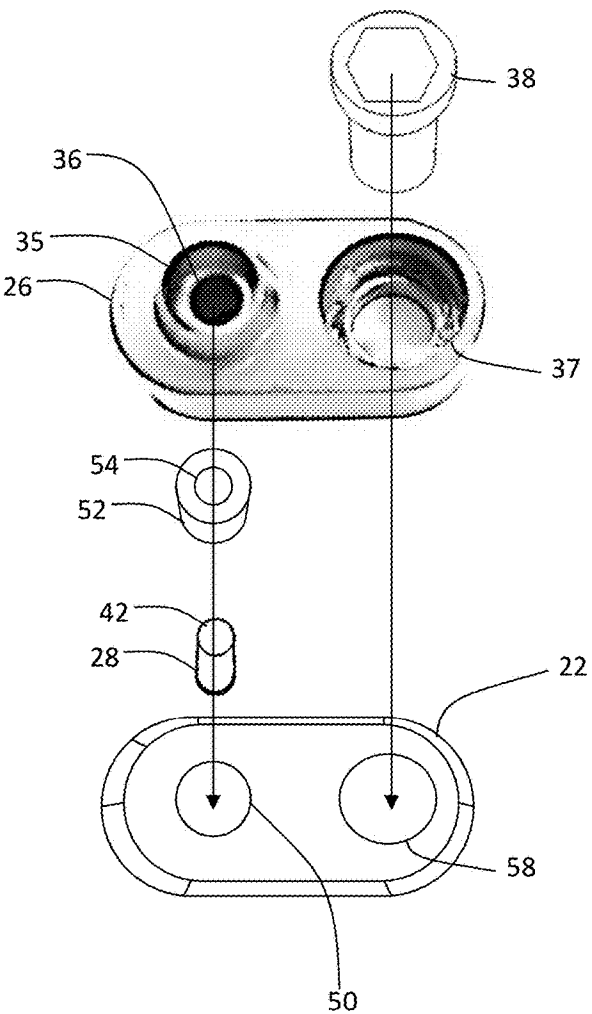
FIG. 7 is a exploded view of an alternate view of the insert assembly of FIG. 6.
Figure 8:
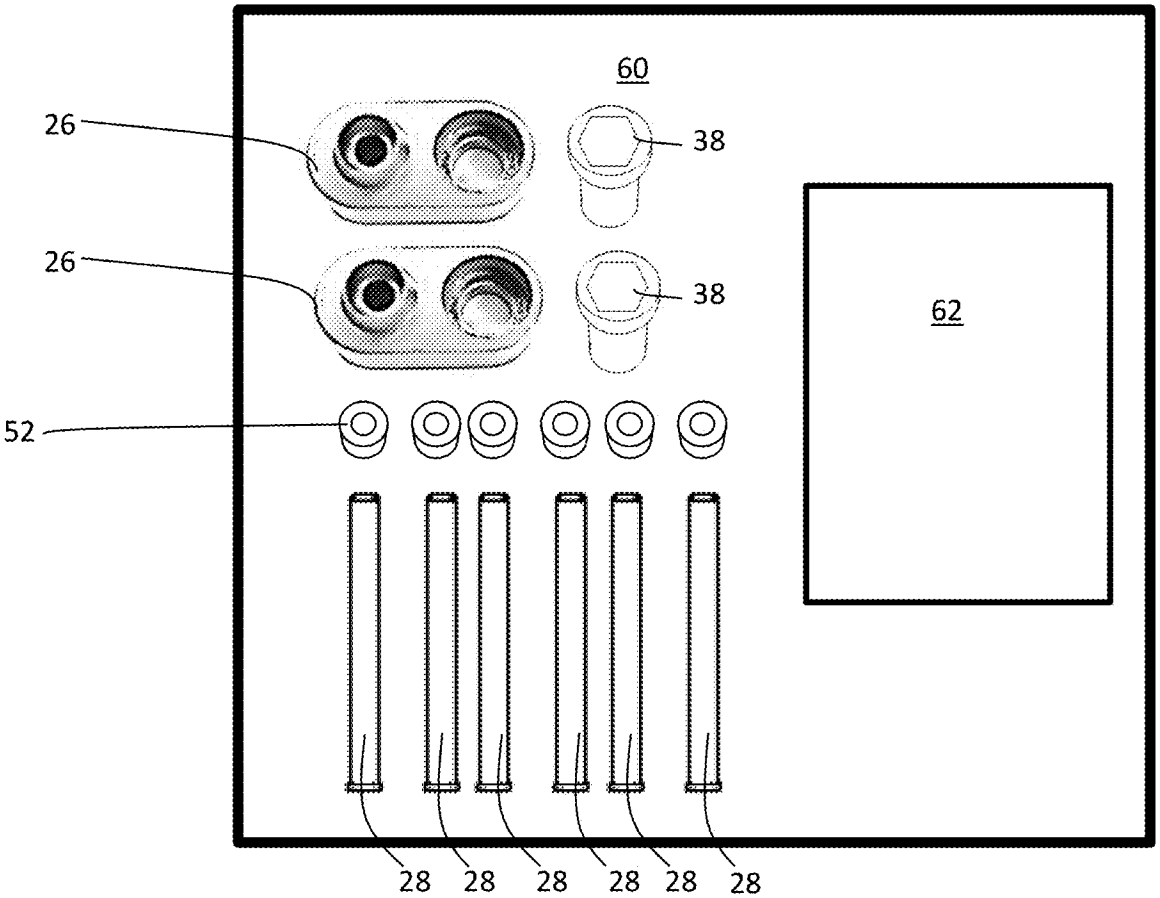
FIG. 8 illustrates a kit comprising insert assemblies with inserts of the type shown in FIGS. 1-7 in addition to instructions for assembly of the pins with the insert and a rotary cylinder.

FIG. 1 is an exploded view of an exemplary arrangement of a rotary die cutting cylinder assembly 20, showing recesses 22 on an outer diameter surface of a cylinder body 24, and plurality of inserts 26 that may be formed therein. Each of the inserts may have one or more ejector pins 28 and may have one or more die cavities 30, depending upon the application. The rotary die cutting cylinder has a compressible core 32 and axial opposite journal bearers 34. The compressible core 32 may be a sleeve of polyurethane or rubber-like material. The journal bearers 34 may allow the rotary cutting cylinder assembly 20 to rotate relative to the equipment in which the rotary cutting cylinder assembly is installed. The recesses 22 may be formed on the outer diameter surface of the cylinder body 24 and sized to fit the outer peripheral shape of the insert 26. The depth of the recess 22 may be such that when the insert 26 is received in the recess, the insert may be generally flush with outer surface of the rotary die cutting cylinder body 24 with a die cutting edge 35 of the insert, if provided, extending outward therefrom. One or more inserts 26 may have die cavities 30 and each insert may have one or more ejector pin locator holes 36. The ejector pin locator holes 36 may be in positions in the die cavity to maximize the ability of the ejector pin 28 to eject a slug from the die cavity 30 once the media is cut. The insert 26 may also have ejector pin locator holes 36 outside of any provided die cavity, as the application requires. The insert 26 may also be provided with a fastener hole 37 having a counter bore through which a mechanical fastener 38, for instance, a socket head cap screw, may be directed in removably attaching the insert in the recess of the rotary cutting die cylinder.

In the example of the anvil roll with an insert and pin eject feature, the anvil may have the same general construction as the rotary die cutting cylinder shown in FIG. 1, but without a die cavity or cutting surfaces. Depending upon the application, the pins may project from the insert received in the anvil roll outer diameter surface in areas that come in register with the die cavities of the rotary die cutting cylinder at selected points of rotation of the anvil roll and rotary die cutting cylinder or areas outside of the die cavities of the rotary die cutting cylinder at selected points of rotation of the anvil roll and rotary die cutting cylinder.

The ejector pin 28 comprises an elongate member with proximal and distal ends 40,42. The pin proximal end 40 is configured to be received in the ejector pin locator hole 36 of the insert 26 from an inside surface 44 of the insert such that the pin distal end 42 projects from an outer surface of the insert 46 when the pin 28 is installed with the rotary die cutting cylinder body. The pin proximal end 40 may have an enlarged diameter portion. For instance, as shown in the drawings, the pin proximal end 40 may comprise an annular boss extending circumferentially around the pin proximal end. The pin ejector hole 36 may extend from the inside surface 44 of the insert to the outer surface 46 of the insert. The pin ejector hole 36 may have a large diameter portion 48 extending from the inside surface 44 of the insert to an intermediate position in the insert to form a shoulder 49 in the insert which is spaced from the outer surface 46. The cylinder body recess 22 may have a through hole 50 extending from the bottom surface of the recess to the interior of the rotary cutting die cylinder adjacent to the compressible core 32. A bushing 52 may be received in the recess through hole 50 and the large diameter portion 48 of the pin ejector hole. The bushing 52 may have a loose fit with the large diameter portion 48 of the pin ejector hole 36 and the through hole 50 of the recess 26, thereby allowing the bushing to be inserted and removed from the pin ejector hole from the inside surface 44 of the insert 26, and to allow the bushing to be removed from the through hole of the recess. The bushing 52 may have a bore 54 that may have a dimension that provides a loose fit with the pin 28, thereby allowing the pin to slide freely in the bushing bore with some side to side play. The bushing 52 may be disposed between the shoulder 49 and the compressible core 32 when the insert 26 is received in the recess 22. The enlarged diameter portion of the pin proximal end 40 may abut the bushing 52 on one side and the compressible core 32 on the other side thereby maintaining the pin 28 in sliding engagement with the insert 26. The pin distal end 42 may be rounded to reduce the tendency of adhesive to adhere to the ejector pin and to limit the ejector pin from penetrating the slug and retaining the slug in the cavity.

In accordance with one aspect of the disclosure, the pin 28 may be assembled with the cutting cylinder body 24 by inserting the pin 28 in the bushing bore 54, inserting the bushing 52 (with the pin inserted in the bushing bore) in the through hole 50 of the recess 22 with one side of the enlarged diameter portion of the pin proximal end 40 resting against the bushing and the other side against the compressible core 32. The insert 26 may then be received in the recess 22 with the projecting portion of the bushing 52 in register with large diameter portion 48 of the pin ejector pin hole 36 and the pin projecting therefrom. The insert 26 may then be secured in place by directing the mechanical fastener 38 into the mounting hole 37 of the insert and a threaded hole 58 formed in the recess 22. The insert 26, the pin 28, and the bushing 52 may be mounted in an anvil roll in a like manner.

In accordance with another aspect of the disclosure, the ejector pins 28, inserts, bushings, and mechanical fasteners may be supplied in a kit 60 together with a flexible die and/or rotary die cutting cylinder assembly 20 and/or anvil roll and/or its component parts. Operators using the rotary die cutting cylinder assembly 20 may access the kit 60 and be directed through instructions 62 for arranging the inserts 26, ejector pins 28, bushings 52, and/or mechanical fasteners 38 in one or more holes of the die cavity depending upon the type of die utilized. For an anvil roll, the operator may be directed through instructions to arrange the inserts 26, ejector pins 28, bushings 52, and/or mechanical fasteners 38 in one or more holes that match with the die cavity, or are outside of the die cavity, depending upon the type of anvil roll and rotary die cutting cylinder utilized. The instructions may include text or other indicia directing use of the inserts 26, ejector pins 28, bushings 52, mechanical fasteners 38, and/or rotary die cutting cylinder assembly 20 and/or anvil roll and/or its component parts. The inserts 26, ejector pins 28, bushings 52, and/or mechanical fasteners 38 may be sold separately, in the kit 60, or distributed together with the rotary die cutting cylinder assembly 20, and/or anvil roll. The inserts 26, ejector pins 28, bushings 52, and/or mechanical fasteners 38 may be sold separately and provided with sufficient instructions 62 directing the user to insert the ejector pins and bushings in the inserts, and into the recesses of the rotary die cutting cylinder or anvil roll as described previously. In connection with the sale or distribution of the inserts 26, ejector pins 28, bushings 52, and/or mechanical fasteners 38, cylinder 20 or compressible core 32, the user (e.g., a purchaser of the ejector pins) is instructed that the purpose of the ejector pins, flexible die, or compressible core, is to remove, and install the components in a rotary die cutting cylinder and/or anvil roll as described previously. Several different length pins may be provided in the kit to provide operational flexibility given the media thickness, media composition, and depth of cut. Thus, the user is induced to replace, remove, and install the components in a rotary die cutting cylinder and/or anvil roll as described previously.

As is seen in the foregoing description, the insert, pin, bushing and mechanical fastener, and their method of installation allows for maintaining the concentricity of the die which contributes to the quality of the products being produced by the process. The insert assembly and its method of installation are versatile and allow for use in a variety of different die and rotary cutter configurations, for instance, cutting blade size and dimensions, ejector pin hole locations and sizes, cylinder diameters, and differently shaped die cavities and ejector pin sizes. For instance, the ease of assembly of the insert and the pin with the cylinder allows an operator more flexibility in fine tuning operations, for instance, selecting a length of the pin needed for a given process based upon factors such as media thickness, media composition, depth of cut, die blade size, etc. The insert assembly is relatively inexpensive to manufacture and may be easily assembled with the die cutting cylinder.

The embodiments were chosen and described in order to best explain the principles of the disclosure and their practical application to thereby enable others skilled in the art to best utilize the disclosed embodiments and with various modifications as are suited to the particular use contemplated. As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. An insert assembly configured to be removably attached to an outer diameter surface of a cylinder of a rotary die cutting arrangement comprising a rotary die cutting cylinder and an anvil roll, the cylinder having a compressible core in an interior of the cylinder, the insert assembly comprising:

an insert configured to be received in a recess on the outer surface of the cylinder, the insert having a pin ejector pin hole arranged on the insert such that when the insert is received in the recess, the pin ejector pin hole communicates with a hole in the recess of the cylinder outer surface which cylinder recess hole extends into the interior of the cylinder; and a pin having proximal and distal ends, the pin distal end configured to engage a media passing between the rotary die cutting cylinder and the anvil roll when the pin assembled with the insert and the cylinder, the pin being configured to be received in the pin ejector hole of the insert;

wherein when the pin is inserted in the pin ejector pin hole, the pin proximal end is configured to be received in the recess hole adjacent to the compressible core and the distal end projects from an outer surface of the insert;

wherein the pin is slidingly engagable with the insert in the pin ejector pin hole in a manner whereby when the pin is assembled with the insert and the insert is assembled with the cylinder, the pin proximal end operatively engages the compressible core when the pin retracts into the pin ejector pin hole of the insert and the pin proximal end operatively engages the insert when the pin projects from the pin ejector pin hole.

2. The insert assembly of claim 1 further comprising a die cut edge on the insert outer surface around the pin ejector pin hole.

3. The insert assembly of claim 1 further comprising a bushing configured to be received in the pin ejector pin hole.

4. The insert assembly of claim 3, wherein the pin ejector pin hole has an internal shoulder.

5. The insert assembly of claim 4, wherein the bushing is configured to be positioned between the shoulder and the compressible core when the insert is received in the recess.

6. The insert assembly of claim 3, wherein the pin is slidingly engagable with the insert in the pin ejector pin hole in a manner whereby when the pin is assembled with the insert and the insert is assembled with the cylinder, the pin proximal end engages the bushing when the pin projects out of the pin ejector pin hole.

7. The insert assembly of claim 1 further comprising a mechanical fastener configured to removably mount the insert assembly to the cylinder.

8. An insert assembly configured to be removably attached to an outer diameter surface of a cylinder of a rotary die cutting arrangement comprising a rotary die cutting cylinder and an anvil roll, the cylinder having a compressible core in an interior of the cylinder, the insert assembly comprising:

an insert configured to be received in a recess on the outer surface of the cylinder with a first side of the insert exposed from the recess and a second side of the insert facing the recess, the insert having a pin ejector pin hole with a first bore, the pin ejector pin hole being arranged on the insert such that when the insert is received in the recess, the pin ejector pin hole communicates with a hole in the recess of the outer surface of the cylinder which cylinder recess hole extends into the interior of the cylinder; and a pin having proximal and distal ends, the pin distal end being configured to engage a media passing between the rotary die cutting cylinder and the anvil roll when the pin is assembled with the insert and the cylinder, the pin being configured to be received in the pin ejector hole of the insert and being dimensioned to slide within the pin ejector hole first bore, wherein when the pin is inserted in the pin ejector pin hole, the pin proximal end is configured to be received in the recess hole adjacent to the compressible core and the distal end projects from an outer surface of the insert;

wherein when the pin is assembled with the insert, and the insert is assembled with the cylinder, the pin proximal end operatively engaging the compressible core when the pin retracts into the pin ejector pin hole of the insert and the pin proximal end operatively engages the insert when the pin projects from the pin ejector pin hole.

9. The insert assembly of claim 8, wherein the insert pin ejector pin hole has a second bore larger than the first bore, the second bore extends from the second side of the insert to a position intermediate of the first and the second sides of the insert.

10. The insert assembly of claim 9, further comprising a bushing configured to be received in the pin ejector pin hole second bore.

11. The insert assembly of claim 10, wherein the bushing is dimensioned to be received in the cylinder recess hole.

12. The insert assembly of claim 11, wherein the bushing is positionable in the second bore between the insert and compressible core when the insert is received in the recess.

13. The insert assembly of claim 11, wherein the pin proximal end engages the bushing when the pin is assembled with the insert and the insert is assembled with the cylinder and when the pin projects out of the pin ejector pin hole.

14. The insert assembly of claim 8 further comprising a mechanical fastener to removably mount the insert assembly to the cylinder.

15. The insert assembly of claim 10, wherein the bushing bore is dimensioned to have a loose sliding fit with the pin.

* * * * *